US008515301B2

(12) United States Patent
Niijima

(10) Patent No.: US 8,515,301 B2
(45) Date of Patent: Aug. 20, 2013

(54) IMAGE FORMING DEVICE AND METHOD OF FORMING IMAGE

(75) Inventor: Yoshio Niijima, Tokyo (JP)

(73) Assignee: Oki Data Corporation, Tokyo (JP)

( * ) Notice: Subject to any disclaimer, the term of this patent is extended or adjusted under 35 U.S.C. 154(b) by 578 days.

(21) Appl. No.: 12/782,206

(22) Filed: May 18, 2010

(65) Prior Publication Data

US 2010/0296824 A1 Nov. 25, 2010

(30) Foreign Application Priority Data

May 22, 2009 (JP) ..... 2009-124761

(51) Int. Cl.
*G03G 15/08* (2006.01)

(52) U.S. Cl.
USPC ..... 399/53; 399/257

(58) Field of Classification Search
USPC ..... 399/27, 29, 53, 257
See application file for complete search history.

(56) References Cited

U.S. PATENT DOCUMENTS

| | | | | |
|---|---|---|---|---|
| 6,766,121 | B2 | 7/2004 | Nonaka et al. | |
| 2003/0123907 | A1 * | 7/2003 | Nonaka et al. | 399/257 |
| 2004/0086286 | A1 * | 5/2004 | Ishii et al. | 399/27 |

FOREIGN PATENT DOCUMENTS

| | | |
|---|---|---|
| JP | A-10-186852 | 7/1998 |
| JP | A-2003-162102 | 6/2003 |
| JP | A-2004-125829 | 4/2004 |
| JP | A-2008-242394 | 10/2008 |

* cited by examiner

*Primary Examiner* — David Gray
*Assistant Examiner* — Gregory H Curran
(74) *Attorney, Agent, or Firm* — Posz Law Group, PLC

(57) ABSTRACT

An image forming device includes an image carrier, an exposing part, a developing member; a developer reserving part; a detection part to detect a developer remaining amount; a first count part to count a rotation number of the image carrier; a second count part to count an exposing dot number; a first calculation part to calculate a print duty for a print sheet based on the rotation number of the image carrier and the exposing dot number; and a discarding part in which when the developer remaining amount is equal to or less than a standard remaining amount, and when the print duty is less than a standard duty, developer is to discard more than the case in which the developer remaining amount is more than the standard remaining amount.

15 Claims, 10 Drawing Sheets

IMAGE FORMING DEVICE AND METHOD OF FORMING IMAGE

CROSS REFERENCE

The present application is related to, claims priority from and incorporates by reference Japanese patent application number 2009-124761, filed on May 22, 2009.

TECHNICAL FIELD

The disclosure of the present application relates to an image forming device such as a printer or a photocopier in an electrographic system and to a method of forming an image on a medium.

BACKGROUND

In a conventional image forming device, the following processes are performed: after the surface of a photoreceptor drum is uniformly charged by a charge roller, an electrostatic latent image is formed on the surface of the photoreceptor drum through exposing by an exposure head; a toner image is formed on the photoreceptor drum by electrostatically adhering toner that is frictionally charged and that is thinned on a developing roller; then, the toner image is transferred onto a sheet by a transferring roller; a print patter is formed on the sheet through fusing the transferred toner image; and remaining toner on the photoreceptor drum is removed by a cleaning device after the transfer.

When a number of counts of printing sheets or a number of rotations of a photoreceptor drum exceeds a predetermined reference value at the time of finishing one sheet printing, toner that stays inside of an image forming unit for a long period of time is mandatorily consumed by printing a print pattern that is expanded in the maximum width in the main scanning direction on a sheet. As a result, degradation of print quality is prevented. See Japanese laid-open patent application publication number 2003-162102 (paragraphs [0013]-[0017], [0027]-[0029], and [0034]-[0040], and FIGS. 2 and 4).

However, in the conventional technology discussed above, because toner is discarded by printing a print pattern that is expanded in the maximum width in the main scanning direction on a sheet at every time of a certain number of counts of printing sheets or a certain number of rotations of the photoreceptor drum, a certain amount of toner is constantly discarded. Therefore, there are the following problems: depending on a print pattern that is printed during intervals between certain numbers of counts of printing sheets, a waste of toner occurs because a toner discarding amount is too much; and a blot occurs because a toner discarding amount is too little.

Furthermore, because toner discarding is performed by printing toner onto a sheet, a waste of sheets occurs. When a print job for a large number of counts of printing sheets is performed, a printing for discarding toner during printing is performed. As a result, there is the following problem: operating rates of an image forming device are decreased because it takes a long period of time for print processing.

An object of the present invention is to prevent a waste of toner at the time of toner discarding and to prevent a blot from occurring by toner discarding processing that corresponds to a print pattern.

SUMMARY

Accordingly, an image forming device of the present application includes: an image carrier; an exposing part configured to form an electrostatic latent image on the image carrier in dot unit; a developing member configured to develop the electrostatic latent image by using developer; a developer reserving part configured to supply the developer to the developing member; a detection part configured to detect a developer remaining amount in the developer reserving part; a first count part configured to count a rotation number of the image carrier during print performance; a second count part configured to count an exposing dot number exposed by the exposing part; a first calculation part configured to calculate a print duty for a print sheet based on the rotation number of the image carrier and the exposing dot number; and a discarding part in which when the developer remaining amount is equal to or less than a standard remaining amount, and when the print duty is less than a standard duty, the developer of the developing member is configured to discard more than the case in which the developer remaining amount is more than the standard remaining amount.

Therefore, the present invention can achieve effects in which it is possible to prevent a blot from occurring by developer discarding processing that is corresponded to a print pattern even though printing in which a developer amount consumed by printing is too little is continuously requested under the situation in which a developer remaining amount is low, in which good print quality can be maintained, and in which wastes of a medium and developer is prevented.

DETAILED DESCRIPTION

An embodiment of an image forming device according to the present invention is explained below with reference to drawings.

First Embodiment

Figure 1:
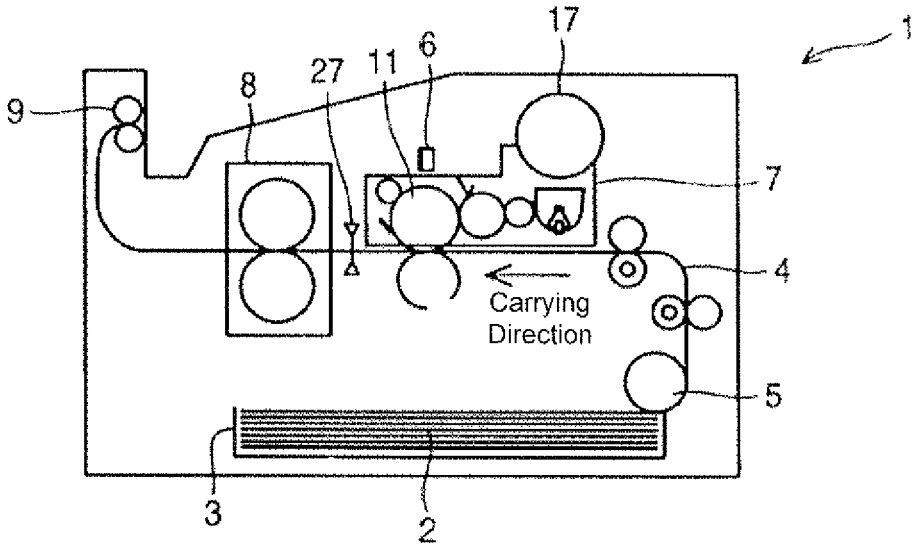
FIG. 1 is a side view of a printer according to a first disclosed embodiment.

In FIG. 1, the reference numeral 1 is a printer that operates as an image forming device. The printer 1 is configured with a cassette 3 in which a sheet 2 is stored as a medium for printing, a pickup roller 5 that feeds the sheet 2 from the cassette 3 to a carrying path 4 sheet-by-sheet, a exposing head 6 that operates as a exposing part, an image forming unit 7 in which toner developing is performed on the sheet 2 that is fed through the carrying path 4, a fusing device 8 that is located at a downstream side in the carrying direction for the sheet 2 in the image forming unit 7 and in which a toner image on the sheet 2 is fused by heat, an ejecting roller 9 that ejects the sheet 2 on which the toner image is fused to outside of the printer 1, and so on.

The exposing head 6 is a device configured as a plurality of dots that forms an electrostatic latent image on a photoreceptor drum 11 as an image carrier having a dot unit as resolution in the main scanning direction of light emitting diode (LED) light, laser light, or the like.

Figure 3:
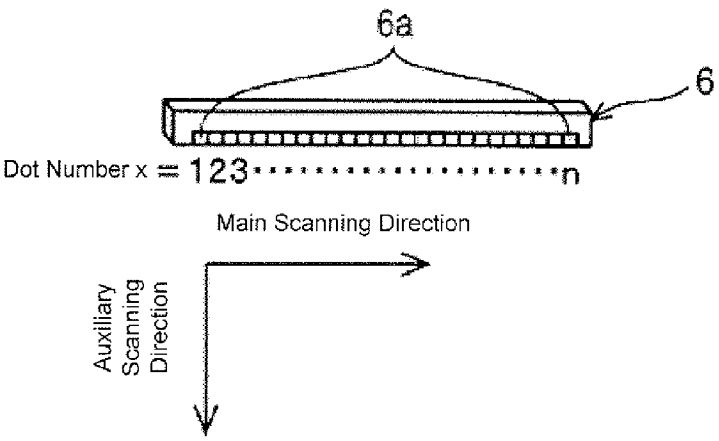
FIG. 3 is a schematic view of an exposing head according to a first disclosed embodiment.

The number of dots of the exposing head 6 in the scanning direction is set to be longer than the length of a largest sheet 2 that can be printed by the printer and that is in the orthogonal direction to the carrying direction of the sheet 2 in consideration of sheet misalignment. As shown in FIG. 3, the exposing head 6 is formed by lining up a plurality of LEDs 6*a* as a light emitting member and using one of the LEDs 6*a* as one dot in the main scanning direction. For example, when the resolution is 600 dpi, six hundred LEDs 6*a* per inch are lined up in the main scanning direction in the order of the dot number x, with the total number of the LEDs 6*a* being n (i.e., x goes from 1 to n, with n being 600). When the resolution is 1200 dpi, twelve hundred LEDs 6*a* per inch are lined up in the main scanning direction in the order of the dot number x, with the total number of the LEDs 6*a* being n (i.e., x goes from 1 to n, with n being 1200). The total number of dots is shown as n dots.

In an explanation below, the term "printable area" means that the number of dots in the main scanning direction corresponds to the number of LEDs 6*a* that are lined up in the main scanning direction (n in this embodiment); and the number of dots in the auxiliary scanning direction corresponds to the length of the sheet 2 in the carrying direction of the sheet 2 (the same as the auxiliary direction in this embodiment), which is assigned by a print instruction. The total number of dots C is calculated by multiplying the number of dots in the main scanning direction by the number of dots in the auxiliary scanning direction, and varies according to sheet size.

A print area is an area in which actual printing is performed and that is assigned by a print instruction. The print area is an area in which a margin area provided on the outer edge of the printable area is taken away from the printable area.

Figure 2:
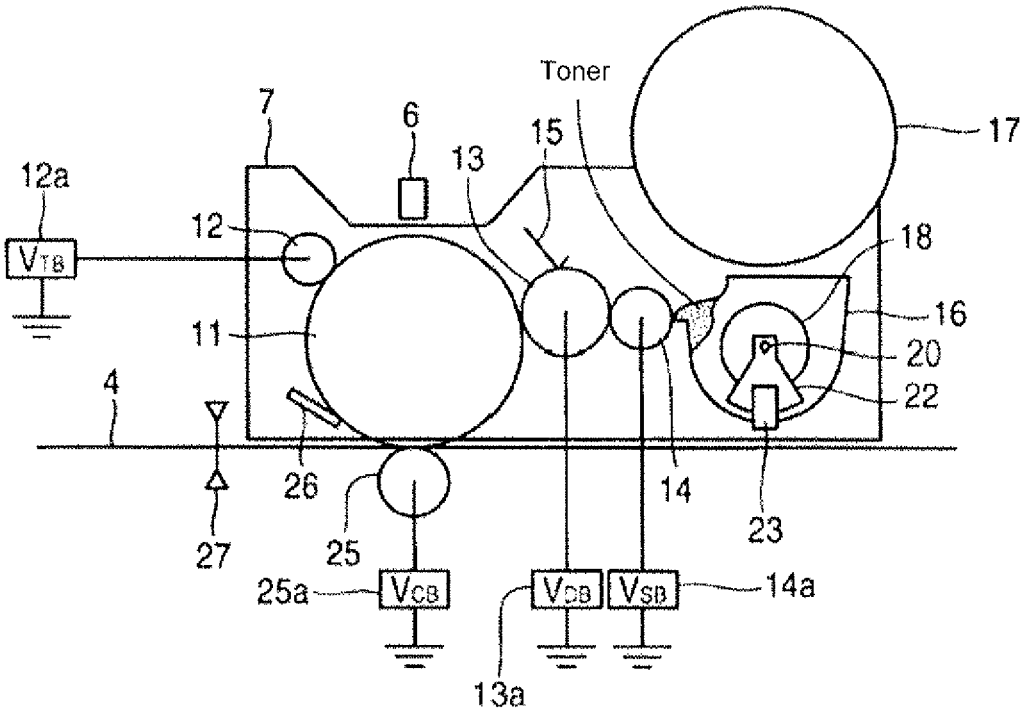
FIG. 2 is a side view of an image forming unit according to a first disclosed embodiment.

In FIG. 2, the photoreceptor drum 11 is an organic system photoreceptor and is formed by laminating a charge generating layer and a charge transporting layer that configures a photo-conductive layer on an aluminum pipe as a conductive base, and so on. The photoreceptor drum 11 is rotated by a driving source (not shown) and has a drum rotation detection sensor 11*a* that operates as an image carrier rotation detection sensor configured with a rotary encoder or the like that detects the number of rotations of the photoreceptor drum 11.

Reference numeral 12 is a charge roller that operates as a charge device and has the following functions. The charge roller 12 is formed by covering a semiconductive rubber material onto a metal shaft. The charge roller 12 is driven to rotate according to the rotation of the photoreceptor drum 11. A voltage $V_{TB}$ that is the same in polarity as the developing toner as a developer is applied to the charge roller 12 from a charge roller power supply part 12*a*. As a result, the photoreceptor drum is uniformly charged.

Reference numeral 13 is a developing roller that operates as a developer carrier and has the following functions. The developing roller 13 is formed by covering a semiconductive rubber material onto a metal shaft. The developing roller 13 is rotated in the opposite direction to the photoreceptor drum 11 in contact with the photoreceptor drum 11 by a line of gears (not shown) provided at the shaft of the photoreceptor drum 11. A voltage $V_{DB}$ that is the same or opposite in polarity as the toner is applied to the developing roller 13 from a developing roller power supply part 13*a*. Toner is electrostatically adhered onto an electrostatic latent image that is formed on the photoreceptor drum 11 by the exposing head 6 so that developing is performed. In other words, toner is supplied to the photoreceptor drum 11 so that a toner image is formed on the photoreceptor drum 11.

Reference numeral 14 is a supplying roller that operates as a developer supplying member and has the following functions. The supplying roller 14 is formed by covering a rubber foam material, such as urethane rubber foam, onto a metal shaft. The supplying roller is rotated in the same direction to the developing roller 13 in contact with the developing roller 13 by a line of gears (not shown) provided at the shaft of the developing roller 13. A voltage $V_{SB}$ that that is the same or opposite in polarity as the toner is applied to the supplying roller 14 from a supplying roller power supply part 14*a* so that toner is supplied to the developing roller 13.

Reference numeral 15 is a developing blade that operates as a developer layer control member and has the following functions. The developing blade 15 is a thin elastic plate in which a layer thickness is, for example, 0.8 mm, and in which the length in a longitudinal direction is substantially the same as the width of the elastic body that configures the developing roller 13. One end of the developing blade 15 is fixed to a frame of the image forming unit 7 in a direction orthogonal to the longitudinal direction. A surface of the developing blade 15 that is a little bit inside from a tip of another end slidably contacts the developing roller 13. As a result, the developing blade 15 controls the thickness of toner to a certain amount by suppressing the strength of such slidable contact, and frictionally charges the toner.

The developing roller 13, the supplying roller 14, and the developing blade 15 together form a developing member, by which an electrostatic latent image on the photoreceptor drum 11 is actualized using toner, according to the present embodiment.

Reference numeral 16 is a toner hopper that operates as a developer reserving part and has the following functions. The toner hopper 16 temporarily reserves toner supplied from a toner cartridge 17 as a developer container and supplies the toner to the developing roller 14.

Figure 4:
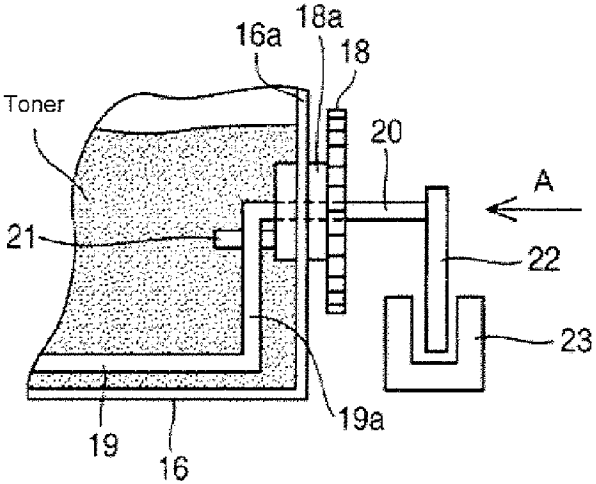
FIG. 4 is a side view of a toner remaining amount sensor according to a first disclosed embodiment.

In FIG. 4, reference numeral 18 is a drive gear. The drive gear 18 is rotatably supported by a hub part 18*a* that is provided at a side plate 16*a* of the toner hopper 16 and is rotatably driven by a driving source (not shown) in the direction of arrow B in FIG. 5.

Reference numeral 19 is a stirring bar and has the following functions. The stirring bar 19 is rotatably supported by the hub part 18*a* of the drive gear 18 and operates as a stirring member that is rotated around a support shaft 20 (which is provided at the same axis as the drive gear 18) as a rotation center. The stirring bar 19 stirs toner inside of the toner hopper 16 by rotating together with the support shaft 20.

Reference numeral 21 is a projection part and has the following functions. The projection part 21 is fixed at a location that is apart from the center of the hub part 18*a* of the drive gear 18 in the radial direction. The projection part 21 is a projection that projects from the hub part 18*a* toward the inside of the toner hopper 19 along a line parallel to the support shaft 20. While the projection part 21 is rotated together with the hub part 18*a*, the projection part 21 pushes an arm part 19*a* of the stirring bar 19 so that the stirring bar 19 is rotated.

Figure 5:
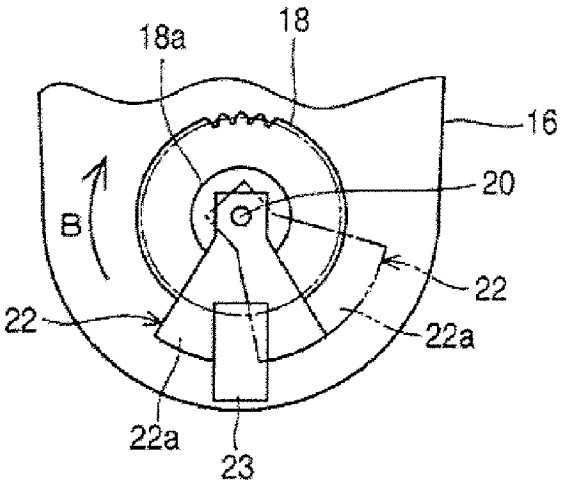
FIG. 5 is a side view seen from the arrow A in FIG. 4 of a toner remaining amount sensor according to a first disclosed embodiment.

Reference numeral 22 is a shielding plate. As shown in FIG. 5, the shielding plate 22 is a plate-like member that has a sector part 22*a* in a sector form that is fixed to an end of the support shaft 20 outside of the toner hopper 16. The shielding plate 22 is rotated in synchronization with the stirring bar 19.

Reference numeral 23 is a toner remaining amount sensor that operates as a developer remaining amount sensor or, more generally, a detection part. The toner remaining amount sensor 23 is an optical sensor in which a light emitting part and a light receiving part are provided opposite each other through the shielding plate 22. The light receiving part detects the blockage of light from the light emitting part. As a result, a level of the remaining amount of toner in the toner hopper 16 is detected.

The arm part 19*a* of the stirring bar 19 is pushed by the projection part 21, which is rotated together with the drive gear 18, so that the stirring bar 19 is rotated in the direction of arrow B from a lower location, where the stirring bar 19 faces right below an upper location, and where the stirring bar 19 faces right above and opposite to a lower location. Because the arm part 19*a* is apart from the projection part 21, after the stirring bar 19 passes the upper location, the stirring bar 19 rotates at a faster speed than the projection part 21 because of its own weight toward the lower location. When the stirring bar 19 hits the upper surface of toner in the toner hopper 16, the rotation is stopped. And then, when the projection part 21 catches up with the arm part 19*a*, the arm part 19*a* is pushed by the projection part 21 again. As a result, since the support shaft 20 is rotated, the stirring bar 19 is periodically rotated inside the toner hopper 16.

In the stirring performance, when the amount of toner remaining is large, the stirring bar 19 is rotated by its own weight and is temporarily stopped on the toner. Then, the stirring bar 19 is pushed by the projection part 21 again and is rotated. During the rotation, when a leading edge side of the sector part 22*a* of the shielding plate 22 that is rotated in synchronization with the stirring bar in the rotation direction B blocks light from the light emitting part of the toner remaining amount sensor 23, the toner remaining amount sensor 23 turns on. Then, when a trailing edge side of the sector part 22*a* of the shielding plate 22 is past the light emitting part of the toner remaining amount sensor 23, the toner remaining amount sensor 23 turns off.

In the case that the amount of toner remaining is small, when the stirring bar 19 is rotated by its own weight and is temporarily stopped on the toner, the following events occur: the toner remaining amount sensor 23 turns on when the sector part 22*a* of the shielding plate 22 blocks light from the light emitting part of the toner remaining amount sensor 23; then, the stirring bar 19 is pushed by the projection part 21 again and is rotated; and when the trailing edge side of the sector part 22*a* of the shielding plate 22 is past the light emitting part of the toner remaining amount sensor 23, the toner remaining amount sensor 23 turns off.

In other words, when the amount of toner remaining is large, an "ON" period of the toner remaining amount sensor 23 is constant for a short period of time regardless of the amount of toner remaining. This means that a period of time for passing the sector part 22*a* of the shielding plate 22 is constant because of the rotation speed of the drive gear 18. When the toner remaining amount becomes small, however, the timing of the turning on of the toner remaining amount sensor 23 is earlier compared with the case in which the toner remaining amount is large. An "ON" period of the toner remaining amount sensor 23 is longer when the toner remaining amount is smaller. A level of the remaining amount of toner in the toner hopper 16 is detected by the duration of the "ON" period of the toner remaining amount sensor 23.

As shown in the two-dot chain line in FIG. 5, the leading edge side of the sector part 22*a* of the shielding plate 22 is set at a location under the following conditions: when the amount of toner remaining reaches a remaining amount criterion Km as discussed below, and when the stirring bar 19 is rotated by its own weight and is temporarily stopped on the toner, the toner remaining amount sensor 23 turns on.

In FIG. 2, reference numeral 25 is a transferring roller and has the following functions. The transferring roller 25 is located opposite to the photoreceptor drum 11 and operates to sandwich the sheet 2 that is carried in the carrying path 4. The transferring roller 25 is rotatably driven by a driving source (not shown) and is independently driven from the photoreceptor drum 11. The transferring roller 25 transfers a toner image that is formed on the surface of the photoreceptor drum 11 onto a sheet 2 through an electric field created by voltage $V_{CB}$ (used as a transferring voltage) applied from a transferring roller power supply part 25*a*.

Reference numeral 26 is a cleaning device and has the following functions. The cleaning device 26 scrapes and removes remaining toner on the surface of the photoreceptor drum 11 by using a cleaning blade after a toner image is transferred. The removed toner is carried and retrieved in a retrieving room located at the toner cartridge 17 through a carrying path (not shown). The cleaning device 26 forms a discarding part, by which developer is discarded from the photoreceptive drum 11 when the control part 35 determines that it should be discarded.

Reference numeral 27 is a medium detection sensor and has the following functions. The medium detection sensor 27 is an optical sensor in which a light emitting part and a light receiving part are provided opposite each other through the carrying path 4. The medium detection sensor 27 is located in a position adjacent to the photoreceptor drum 11 and in the carrying path 4 between the photoreceptor drum 11 and the fusing device 8 of the image forming unit 7. The light receiving part detects the blockage of light from the light emitting part using the sheet 2 as a medium. As a result, the medium detection sensor 27 detects the passing of the sheet 2.

Figure 6:
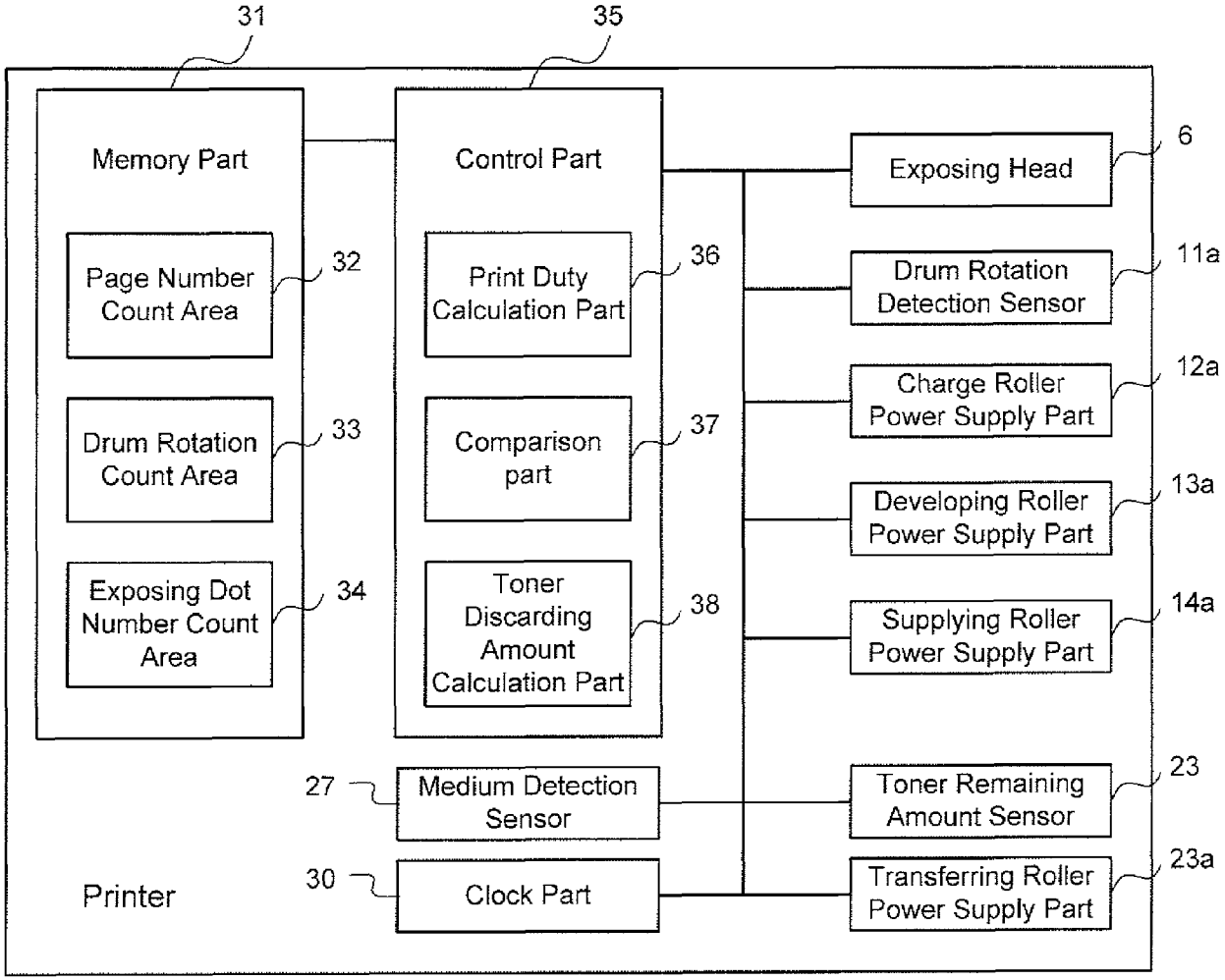
FIG. 6 is a block diagram of a printer according to a first disclosed embodiment.

In FIG. 6, the reference numeral 30 is a clock part and had the following functions. The clock part 30 has a frequency generator or the like including a crystal oscillator or the like. Time is counted based on a generated frequency. An "ON" period and so on of the toner remaining amount sensor 23 are outputted.

Reference numeral 31 is a memory part of the printer 1. A print task execution program that is executed by a control part 35 discussed later is preliminarily stored in the memory part 31. Various types of data used for the program and a processing result from the control part 35 are also stored in the memory part 31.

In the memory part 31, the following areas are preliminarily secured: a page number count area 32, a drum rotation count area 33, and an exposing dot number count area 34. The page number count area 32 operates to count a page number P configured as one print job according to a print instruction. The drum rotation count area 33 operates as a first count part to count a drum actual rotation number Nkr of the photoreceptor drum 11 that is required to print on one sheet 2 according to the output of the drum rotation detection sensor 11*a*.

The exposing dot number count area 34 operates as a second count part to count an exposing dot number C that is exposed by the exposing head 6.

In the memory part 31, the followings are also preliminarily set and stored: a standard duty Kd (3% in this embodiment) that is a standard for judgment of whether toner discarding processing is executed or not; and a standard remaining amount Km (40 g in this embodiment) that is a standard for changing a toner discarding coefficient $\alpha$ according to a toner remaining amount M.

Figure 8A:
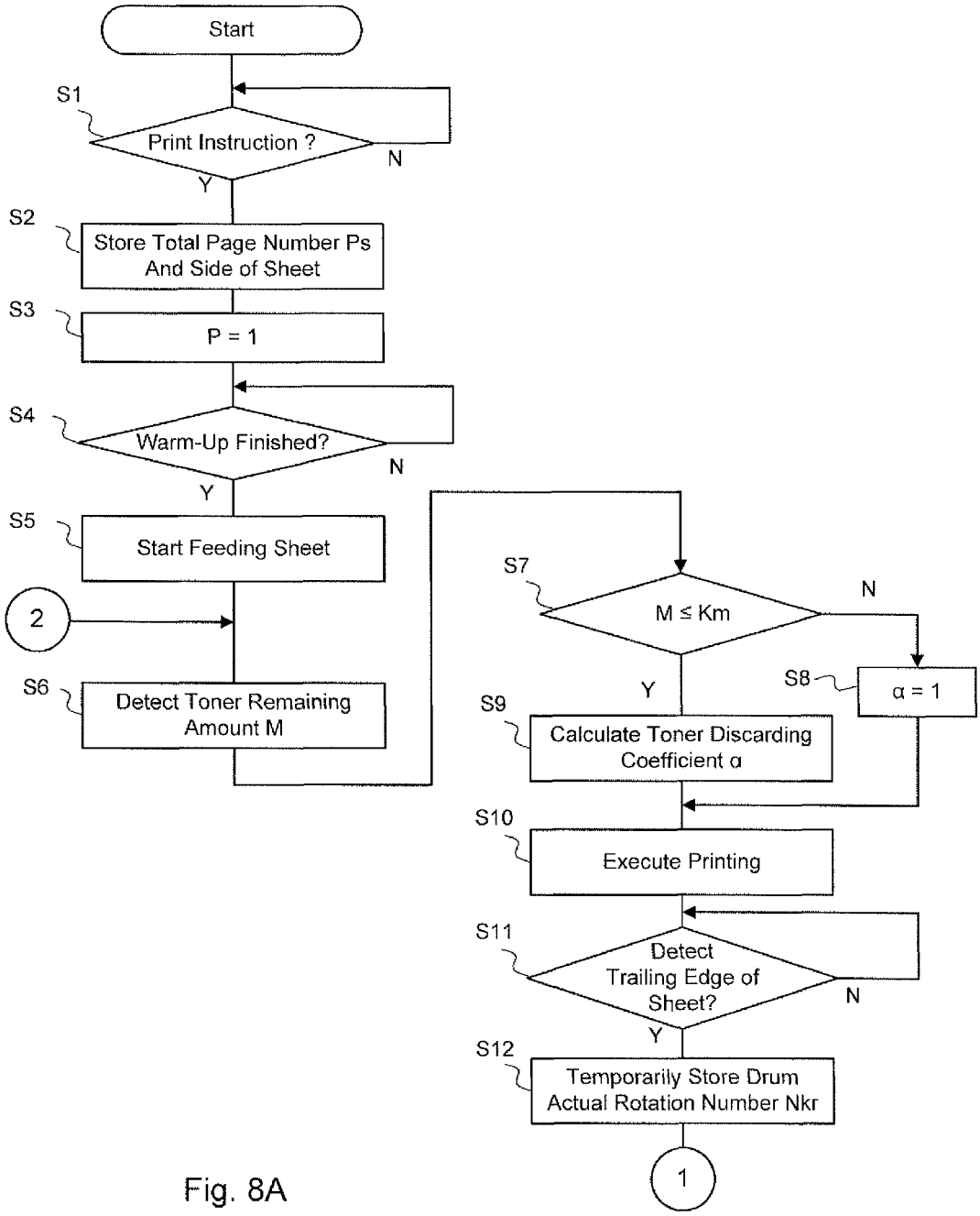
FIGS. 8A and 8B are flow diagrams of print processing and toner discarding processing according to a first disclosed embodiment.
Figure 8B:
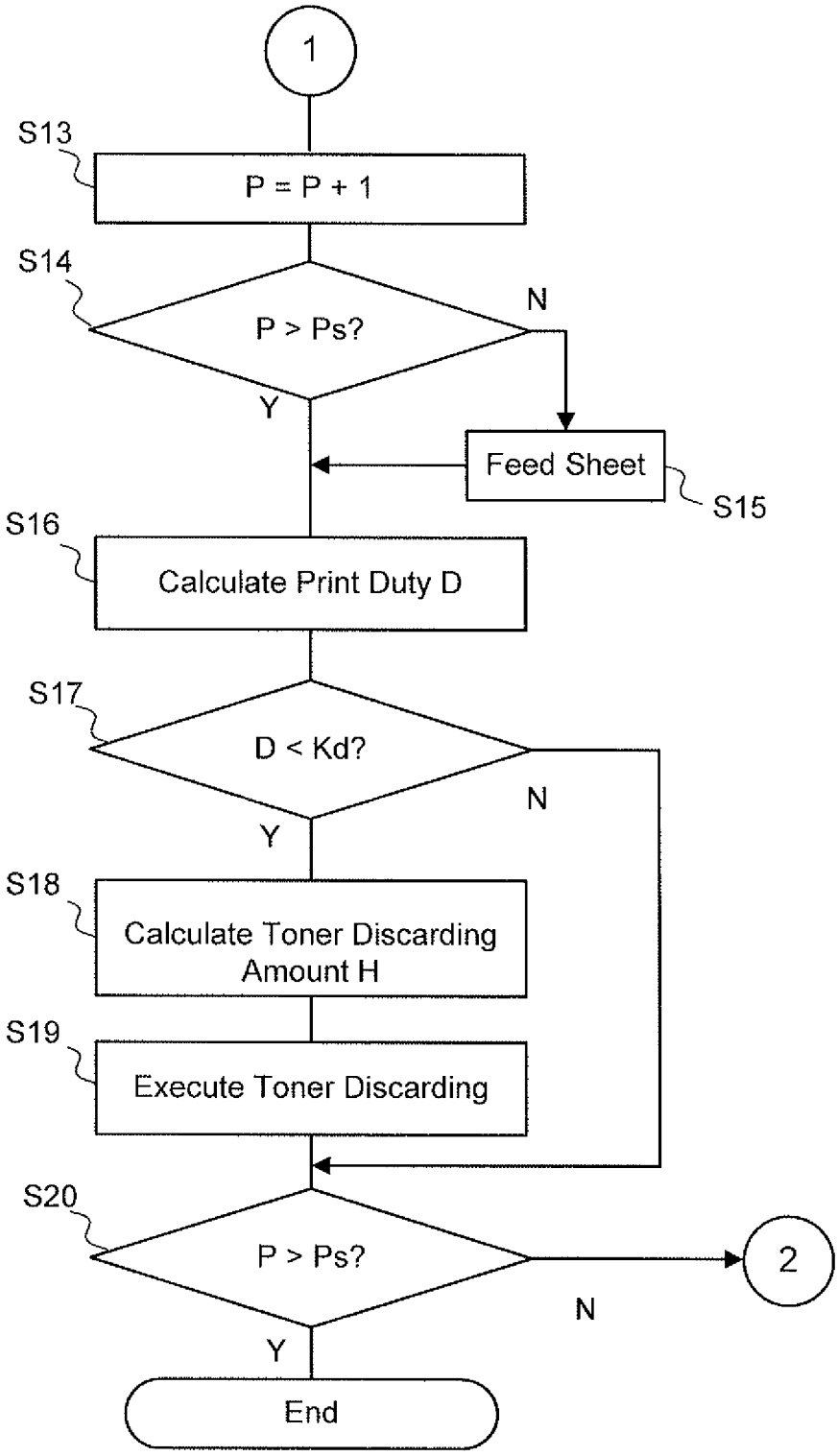

The control part 35 functions to execute task processing, such as print processing and toner discarding processing that are explained with reference to FIG. 8, by controlling each part inside of the printer 1 through the print task execution program stored in the memory part 31.

In the control part 35, for example, the following function parts are formed: a print duty calculation part 36, which operates as a first calculating part, for calculating a print duty D per print sheet in which a median exposing dot number per rotation (which is calculated by the exposing dot number C of the exposing dot number count area 34 and the drum actual rotation number Nkr of the drum rotation count area 33) is converted in an actual print area by software of the print task execution program; a comparison part 37, which operates to compare the calculated print duty D with the standard duty Kd stored in the memory part 31; and a toner discarding amount calculation part 38, which operates as a second calculating part, in which a print pattern (toner discarding pattern) for discarding toner in the toner discarding processing is edited based on a toner discarding amount H (more generally, a developer discarding amount) to be discarded that is calculated according to the difference between the print duty D and the standard duty Kd.

The print performance of the printer 1 according to the present embodiment is explained below.

When a print instruction from a host device (not shown; for example, a personal computer) is received, the control part 35 of the printer 1 instructs the following performance: print data for a sheet 2 is generated, and warm-up is started by rotating each roller while a certain voltage is applied to the each roller in the image forming unit 7; when the rotation speed of the photoreceptor drum 11 reaches a certain rotation speed, the sheet 2 that is assigned by the print instruction is fed from the cassette 3 to the carrying path 4 by the pickup roller 5; when the sheet 2 reaches the image forming unit 7, the generated print data is sent to the exposing head 6; and an electrostatic latent image of an print pattern is formed on the surface of the photoreceptor drum 11 by exposing light emitted from the LED 6*a* of the exposing head 6 according to the print data on the surface of the photoreceptor drum 11 that is uniformly charged with a certain polarity and voltage by the charge roller 12 driven contacting the photoreceptor drum 11 so as to decrease surface potential of the exposed region.

In this case, the supplying roller 14 is rotated while contacting the developing roller 13 and toner in the toner hopper 16 is supplied to the surface of the developing roller 13. The toner supplied onto the surface of the developing roller 13 is formed into a thin layer by the developing blade 15 that slidably contacts the developing roller 13. The toner, which is charged by friction with the developing blade 15 and by the applied voltage $V_{DB}$, is adhered to the electrostatic latent image on the photoreceptor drum 11 that is rotated while contacting the developing roller 13. As a result, a toner image is sequentially formed.

And then, the toner image on the photoreceptor drum 11 is sequentially transferred onto the sheet 2 by the electric field of the voltage $V_{CB}$ that is applied to the transferring roller 25 from the transferring roller power supply part 25*a*. After the toner image is transferred, toner remaining on the surface of the photoreceptor drum 11 is removed by scraping with the cleaning blade of the cleaning device 26. The removed toner is carried and retrieved in the receiving room of the toner cartridge 17 (a series of performance by the cleaning device 26 is referred to as cleaning performance).

The toner image transferred onto the sheet 2 is carried to and fused at the fusing device 8. The sheet 2 on which the print pattern based on the print data is printed is ejected to the outside of the printer 1 by the ejecting roller 9. When the print performance is for printing one sheet, the rotation of the photoreceptor 11 is stopped.

When the print performance is for continuing printing of several sheets, the rotation of the photoreceptor drum 11 is stopped after a sheet on which a last page is printed is ejected.

While the warm-up is executed, the voltages $V_{DB}$ and $V_{SB}$ are applied to the developing roller 13 and the supplying roller 14, respectively. At the same time, toner in the image forming unit 7 is charged during the warm-up because the developing roller 13 and the supplying roller 14 are rotated in accordance with the rotation of the photoreceptor drum 11.

While the print performance is executed, the case in which toner amount consumed through printing is excessively low may be continued because a dot number of a toner image to be printed is excessively low depending on a print patter printed on the sheet 2.

In this case, toner adhered on the surface of the developing roller 13 is not adhered to the photoreceptor drum 11 and remains on the surface of the developing roller 13. Since the remaining toner continues to be rubbed at contact parts with the supplying roller 14, the developing blade 15, and the photoreceptor drum 11, electric potential due to frictional electrification may be excessively increased. Toner with an excessive amount of charge is adhered onto the photoreceptor drum beyond necessity at the time of developing an electrostatic latent image. As a result, a blot may occur on the sheet in which printing finishes.

In this explanation, a blot means that toner is adhered onto the background part of an image, i.e., a non-image part, by excessively charged toner that has an excessive amount of charging compared with normally charged toner.

The excessively charged toner that causes the blot is referred to as blot toner.

In order to prevent the blot on the sheet in which printing finishes from occurring, it is necessary that the blot toner having an excessive amount of charging is removed before a toner image is transferred on the sheet 2, such that the occurrence of the blot toner is inhibited.

In the present embodiment, the following toner discarding performance is executed to remove the blot toner and to inhibit the occurrence of the blot toner: toner of the developing roller 13 is adhered to an electrostatic latent image of a toner discarding pattern formed on the photoreceptor drum 11 under certain conditions; after that, the toner adhered to the electrostatic latent image remains on the photoreceptor drum 11 without applying the voltage $V_{CB}$ to the transferring roller 25; and the toner is removed by scraping through the cleaning blade of the cleaning device 26.

The toner discarding performance of the printer 1 according to the present embodiment is explained below.

Determination of whether the toner discarding performance according to the present embodiment is performed or not is executed based on a level of the toner amount consumed by printing.

Specifically, the control part 35 that receives a print instruction instructs the following print performance on one sheet 2:

while the number of rotations of the photoreceptor drum 11 is detected based on output from the drum rotation detection sensor 11*a*, the drum actual rotation number Nkr of the photoreceptor drum 11 is counted in the drum rotation count area 33 in the memory part 31; and the exposing dot number C that is exposed by the exposing head 6 when the electrostatic latent image is formed on the photoreceptor drum 11 is counted in the exposing dot number count area 34.

In this case, the drum actual rotation number Nkr means the following: when the developing roller 13 is rotated with the photoreception drum 11, toner on the surface of the developing roller 13 is frictionally charged by rubbing at the contact parts with the supplying roller 14, the developing blade 15, and the photoreceptor drum 11. As a result, the drum actual rotation number Nkr of the photoreceptor drum 11 is counted by counting the number of rotations of the photoreceptor drum 11 in the print performance on one sheet 2. The number of rotations of the photoreceptor drum 11 includes the timing from the time of the feeding of a leading edge of one sheet 2 from the cassette 3 through the time of detecting a trailing edge of the sheet 2 by the medium detection sensor 27 that is located in the downstream side in the carrying direction of the photoreceptor drum 11 of the image forming unit 7. It also includes a vacuity carrying length in which a toner image is not transferred on the sheet 2.

The control part 35 calculates the median exposing dot number per rotation (C/Nkr) of the drum actual rotation number Nkr through these two count values by the print duty calculation part 36. Then, the print duty D per print sheet that converts the median exposing dot number per rotation into an actual print area of the sheet 2 that is used for printing is calculated through the following formula (1).

In other words, when solid printing on an entire surface of the printable area of a size of the sheet 2 that is used for printing is performed, a total dot number (multiplying the number of dots in the main scanning direction and the number of dots in the auxiliary scanning direction) is set as Cs. A drum print rotation number that corresponds to only the print area of the size of the sheet 2 that is used for printing, i.e., that corresponds to the length in the carrying direction of the printable area of the sheet 2 except the margin area is set as Nki. The print duty D is calculated by the following formula (1).

$$D=100\times(Nki\times C/Nkr)/Cs(\text{unit:}\%) \quad (1)$$

A higher print duty D means that a toner consumption amount in current print performance is large. A lower print duty D means that a blot is likely to occur in the next print performance because the toner consumption amount in current print performance is small.

In the print duty D, when solid printing is performed on an entire surface of the printable area of one sheet 2, i.e., when the margin area is not set, its area ratio is referred to as the 100% duty. On the other hand, printing that corresponds to 1% of the area is referred to as the 1% duty.

Next, the control part 35 instructs the comparison part 37 to compare the calculated print duty D with the standard duty Kd stored in the memory part 31. When the calculated print duty D is equal to or more than the standard duty Kd, the toner discarding performance is not conducted. When the calculated print duty D is less than the standard duty Kd, the toner discarding performance is executed.

Then, when the execution of the toner discarding performance is determined, the control part 35 instructs to calculate the toner discarding amount H through the toner discarding amount calculation part 38 in which the toner discarding amount H is proportional to the difference that is calculated by deducting the print duty D from the standard duty Kd. The toner discarding amount H is calculated as follows, according to formula (2):

$$H=\alpha(Kd-D)(\text{unit:}\%) \quad (2)$$

Here, $\alpha$ represents a toner discarding coefficient (normally, $\alpha=1$).

A discarding dot number DT of the toner discarding pattern that corresponds to the calculated toner discarding amount H is calculated by the following formula (3):

$$DT=H\times Cs=\alpha(Kd-D)Cs(\text{unit:dot}) \quad (3)$$

Then, the control part 35 is instructed to send print data for the toner discarding pattern that is generated based on the discarding dot number DT to the exposing head 6 so that the toner discarding performance is executed.

The toner discarding pattern includes a strip-shaped pattern that is formed by emitting light from the exposing head 6 for a certain period of time onto an entire area of the printable area in the main scanning direction. In other words, the strip-shaped pattern has a length in the scanning direction that corresponds to a length in the shaft direction of a toner layer formed on the developing roller 13.

It is preferred that the toner discarding performance is executed during print performance except a period of performance for transferring a toner image onto the sheet 2, i.e., after the sheet 2 is fed from the cassette 3 and before the printed sheet 2 is ejected, in order to shorten a print processing time.

The toner discarding performance is effective when the toner remaining mount M in the image forming unit 7 is large. However, when the toner remaining amount M in the toner hopper 16 is small by consuming all of toner stored in the toner cartridge 17, a blot likely occurs by the blot toner, which has an excessive amount of charging compared with the situation in which the toner remaining amount M in the image forming unit 7 is large. Because the toner amount supplied by the supplying roller 14 to supplement toner is decreased after toner is adhered to the photoreceptor drum 11 from the developing roller 13, the toner adhered on the surface of the developing roller 13 is rubbed for a longer period of time at the contact parts with the supplying roller 14, the developing blade 15, and the photoreceptor drum 11.

In other words, when the toner discarding amount H that is calculated by multiplying the toner discarding coefficient $\alpha$ by the difference that is calculated by deducting the print duty D from the standard duty Kd according to the formula (2) above is used, a blot may occur because the discarding amount is deficient.

In order to avoid the above situation, the toner discarding amount H is varied depending on a level of the toner remaining amount M in the image forming unit 7 that is calculated by an "ON" period of the toner remaining amount sensor 23 discussed above. In other words, when the toner remaining amount M in the image forming unit 7 is smaller, the toner discarding amount H is larger.

A blot comparison experiment was performed. It was compared between the case in which the toner discarding amount H was calculated in consideration of the toner remaining amount M in the image forming unit 7 and the case in which the toner discarding amount H was calculated without consideration of the toner remaining amount M in the image forming unit 7.

Figure 7B:
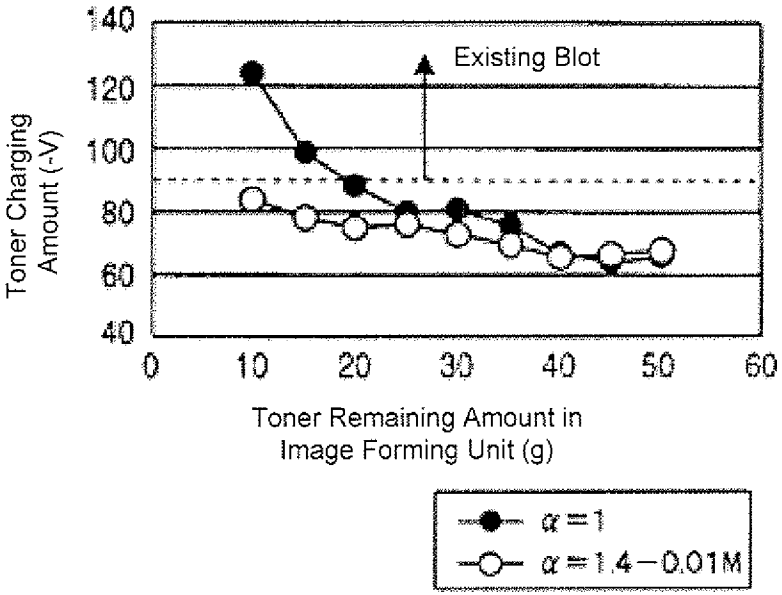
FIGS. 7A and 7B are graphs of comparison of a blot between the cases of considering a toner remaining amount M and not considering a toner remaining amount M in an image forming unit.
Figure 7A:
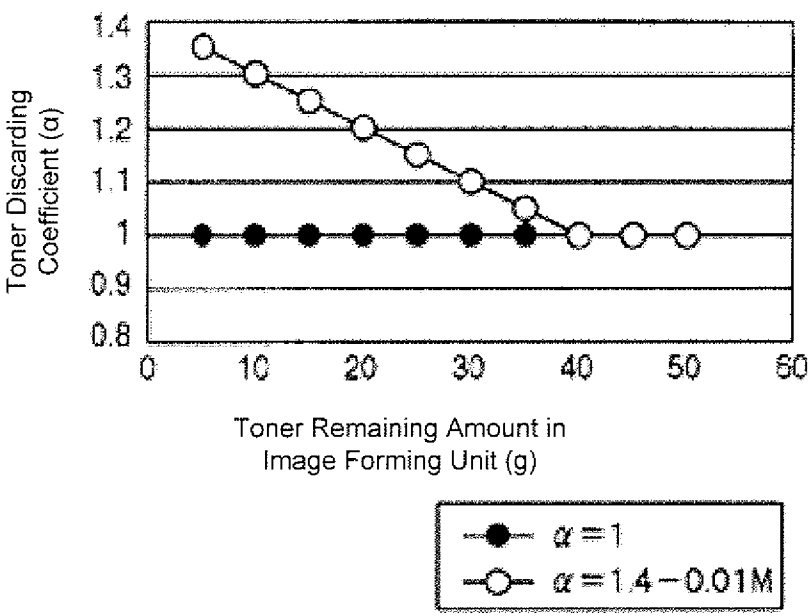

FIGS. 7A and 7B are graphs of comparison of a blot between the cases of considering the toner remaining amount M and not considering the toner remaining amount M in the image forming unit 7.

The experiment was performed under the following conditions: a new image forming unit 7 was used; the circumstance was at the temperature of 23° C. and humidity of 50%; continuous printing was performed with a print duty of 1%; and an interval of printing was one sheet every 10 seconds.

The standard duty Kd was 3%. This was based on the following knowledge through experiments: when a print duty is equal to or more than 3%, the toner consumption amount is large; and therefore, a blot did not occur even though the toner discarding performance was not conducted.

In the comparison experiment, there were two types of experiments as shown in FIG. 7A. The experiments were performed to compare these two types of experiments. The one type was that the toner discarding amount H is constant regardless of the toner remaining amount M (toner discarding coefficient $\alpha$ is 1 ($\alpha$=1); see the formula (2)). The other type was that when the toner remaining amount M is equal to or less than 40 g, the toner discarding coefficient $\alpha$ calculated by the following formula (4) is used so that the more the toner remaining amount M was smaller, the more the toner discarding amount H was larger.

$$\alpha=1.4-0.01M \quad (4)$$

Note that the formula (4) was obtained based on several experiments.

There is correlation between amount of charging for the toner and a blot. Toner that was used in the experiments had the following feature: when the toner charging amount was over −90V, a blot began to occur.

As shown in FIG. 7B, in the case in which the toner discarding coefficient $\alpha$ was at a constant value of 1 ($\alpha$=1), and the toner remaining amount M was equal to or less than 20 g, a blot began to occur. However, when the toner discarding amount H was increased in inverse proportion to the toner remaining amount M by using the toner discarding coefficient $\alpha$ shown in the formula (4), the toner charging amount of the developing roller 13 was equal to or less than −90V even though the toner remaining amount M in the image forming unit 7 was small, such as 10 g. And the blot during the print performance did not occur. Therefore, it was understood that when the toner remaining amount M was small, an occurrence of the blot could be prevented by increasing the toner discarding amount H accordingly.

Next, print processing and toner discarding processing according to the present embodiment are explained below in steps, S, with reference to a flow diagram shown in FIG. 8.

After power is applied to the printer 1, a print task execution program that is stored in the memory part 31 of the printer 1 is automatically launched.

At S1, after the print task execution program is launched, a control part 35 of the printer 1 waits for a print instruction of a print job from a host device according to the print task execution program. When the print instruction is received, the processing goes to S2. When the print instruction is not received, a waiting operation is continued.

At S2, the control part 35 that received the print instruction instructs the followings: a warm-up is started; the received print job is stored in the memory part 31; and a total number of pages Ps to be printed and a size of a sheet 2 used for printing are read from the print job and are stored in the memory part 31.

The control part 35 also instructs the following: a margin area that is set is read from the print job; and a drum print rotation number Nki of the photoreceptor drum 11 that corresponds to the length of a print area in the carrying direction and a total number of dots Cs in a printable area are calculated based on the size of the sheet 2 and the margin area that are read, and they are stored in the memory part 31.

At S3, after the total number of pages Ps is read by the control part 35, the control part 35 instructs to set a count number in a page number count area 32 of the memory part 31 as "1" and to set a page number P that is printed at first as "1."

At S4, after the page number P to be printed is set by the control part 35, the control part 35 waits for completion of the warm-up. When the control part 35 recognizes completion of the warm-up, the processing goes to S5. When the control part 35 does not recognize completion of the warm-up, a waiting operation is continued.

At S5, after completion of the warm-up is recognized by the control part 35, the control part 35 instructs the following: carrying the sheet 2 is started by feeding the sheet 2 with the size stored in the memory part 31 to the carrying path 4 from the cassette 3; counting a drum actual rotation number Nkr of the photoreceptor drum 11 is started by a drum rotation count area 33 of the memory part 31 when the leading edge of the sheet 2 is fed from the cassette 3; and the processing goes to S6.

At S6, while the sheet 2 that is fed from the cassette 3 is carried to the image forming unit 7 through the carrying path 4, the control part 35 instructs to detect the toner remaining amount M in the toner hopper 16 of the image forming unit 7 based on an "ON" period of the toner remaining amount sensor 23 by measuring the "ON" period with the clock part 30.

At S7, after the toner remaining amount M is detected by the control part 35, the control part 35 instructs the following: the standard remaining amount Km (40 g in this embodiment) that is stored in the memory part 31 is read; the detected toner remaining amount M and the standard remaining amount Km are compared by the comparison part 37; when it is determined that the toner remaining amount M is equal to or less than the standard remaining amount Km, the processing goes to S9; and when it is determined that the toner remaining amount M is more than the standard remaining amount Km, the processing goes to S8.

At S8, after the control part 35 determines that the toner remaining amount M is more than the standard remaining amount Km (i.e., "No"), the control part 35 instructs to set a toner discarding coefficient $\alpha$ as "1" and instructs that the processing go to S10.

At S9, after the control part 35 determines that the toner remaining amount M is equal to or less than the standard remaining amount Km (i.e., "Yes"), the control part 35 instructs to set the toner discarding coefficient $\alpha$ by calculating it through the formula (4) in order to discard toner in inverse proportion to the toner remaining amount M, and instructs that the processing go to S10.

At S10, after the toner discarding coefficient $\alpha$ is set by the control part 35, the control part 35 instructs to execute printing onto the sheet 2.

Specifically, the control part 35 instructs the following: image data of the page number P is read from the print job that is stored in the memory part 31 based on the current page number P; print data for the page is created based on the image data and the print instruction; the print data is sent to the exposing head 6; and an toner image of a print pattern corresponding to the print data is transferred on the sheet 2 through the above mentioned print performance.

In this time, the control part 35 instructs to count an exposing dot number C that is exposed by the exposing head 6 based on the print data that is outputted to the exposing head 6 through the exposing dot number count area 34 of the memory part 31.

At S11, after printing on the sheet 2 is started by the control part 35, the control part 35 instructs to wait for the detection of the trailing edge of the sheet 2 in the carrying direction while the medium detection sensor 27 monitors passage of the sheet 2. When the trailing edge of the sheet 2 is detected, the processing goes to S12. When the trailing edge of the sheet 2 is not detected, a waiting operation is continued.

At S12, after the control part 35 recognizes that the trailing edge of the sheet 2 is passed through the medium detection sensor 27, the control part 35 instructs the following: counting of the drum actual rotation number Nkr through the drum rotation count area 33 of the memory part 31 finishes; the counted drum actual rotation number Nkr is temporarily stored in the memory part 31; a count number of the drum rotation count area 33 of the memory part 31 is initialized as "0"; and the processing goes to S13.

At S13, after the drum actual rotation number Nkr is temporarily stored by the control part 35, the control part 35 instructs to update a page number P by adding "1" to the current page number P and to set a page number P that is printed at the next time.

At S14, after the page number P is updated by the control part 35, the control part 35 instructs to read a total number of pages Ps that is stored in the memory part 31 and to compare the updated page number P with the total number of pages Ps by the comparison part 37. When the comparison part 37 determines that the page number P is equal to or less than the total number of pages Ps (i.e., "No"), the control part determines that printing is continued. Then, the processing goes to S15.

When the comparison part 37 determines that the page number P is more than the total number of pages Ps (i.e., "Yes"), the control part 35 determines that transferring of the toner image for the last page finishes. Then, the processing goes to S16.

At S15, after the control part 35 determines that printing is continued, the control part 35 instructs the followings: carrying of a new sheet 2 to the image forming unit 7 is started by feeding the new sheet 2 to the carrying path 4 from the cassette 3; when the leading edge of the sheet 2 is fed from the cassette 3, counting of the drum actual rotation number Nkr for the photoreceptor drum is started by the drum rotation count area 33 of the memory part 31; and the processing goes to S16.

At S16, after the control part 35 determines that transferring of the toner image for the last page finishes, or that the carrying of the new sheet 2 to the image forming unit 7 is started, the control part 35 instructs the following: toner that remains on the surface of the photoreceptor drum 11 is removed and retrieved by the above mentioned cleaning performance; the sheet 2 in which transferring of the toner image of the print pattern finishes is carried to the fusing device 8 for fusing the toner image; and the sheet 2 on which the print pattern of the print data is printed is ejected to outside of the printer 1 by the ejecting roller 9.

The control part 35 instructs the following at the same time of this ejecting performance or the ejecting performance with transferring the new sheet 2: a print duty D is calculated through formula (1) based on the drum actual rotation number Nkr that is temporarily stored in the memory part 31, the exposing dot number C in the exposing dot number count area 34 of the memory part 31, the drum print rotation number Nki that is stored in the memory part 31, and the total number of dots Cs.

At S17, after the print duty D is calculated by the control part 35, the control part 35 instructs the following: after the standard duty Kd (3% in this embodiment) that is stored in the memory part 31 is read, the calculated print duty D is compared with the standard duty Kd by the comparison part 37; when the comparison part 37 determines that the print duty D is less than the standard duty Kd (i.e., "Yes"), the processing goes to S18; and when the comparison part 37 determines that the print duty D is equal to or more than the standard duty Kd (i.e., "No"), the processing goes to S20.

At S18, after the control part 35 determines that the print duty D is less than the standard duty Kd, the control part 35 instructs the toner discarding amount calculation part 38 to calculate the toner discarding amount H through formula (2). The toner discarding amount H is in proportion to the difference that is obtained by deducting the print duty D from the standard duty Kd.

At S19, after the toner discarding amount H is calculated by the control part 35, the control part 35 instructs the following: a discarding dot number DT of the toner discarding pattern that corresponds to the toner discarding amount H is calculated through formula (3) by the toner discarding amount calculation part 38; and print data for the toner discarding pattern that is edited based on the discarding dot number DT by reading the total dot number Cs is sent to the exposing head 6 so that the above mentioned toner discarding performance is executed.

At S20, after the toner discarding performance finishes, or after the print duty D is determined to be equal to or more than the standard duty Kd by the control part 35, the control part 35 instructs the following: the updated page number P is compared with the total number of pages Ps by the comparison part 37; when the comparison part 37 determines that the page number P is equal to or less than the total number of pages Ps (i.e., "No"), the processing returns to S6 and continues to print on the next sheet 2; and when the comparison part 37 determines that the page number P is more than the total number of pages Ps (i.e., "Yes"), printing based on the received print instruction finishes.

As explained above, the present embodiment has the following features and effects. The print duty D is calculated based on the drum actual rotation number Nkr of the photoreceptor drum and the exposing dot number C. When the toner remaining amount M that is detected by the toner remaining amount sensor 23 is equal to or less than the standard remaining amount Km and when the print duty D is less than the standard duty Kd, the toner discarding amount H is increased in inverse proportion to the toner remaining amount M. Thus, toner on the surface of the developing roller is discarded with a larger amount compared to the case in which the toner remaining amount M is more than the standard remaining amount Km. As a result, an occurrence of a blot by the blot toner can be prevented by the toner discarding processing that corresponds to the print pattern, even though the toner remaining amount M in the image forming unit is low, and printing in which consumed toner amount for printing is excessively small is continued. Therefore, good print quality is maintained, and a waste of toner and sheets can be prevented.

Because the toner discarding processing is performed during a period of printing performance starting with the feeding a sheet from a cassette and ending with the ejecting of the printed sheet, except a period for transferring a toner image, a waiting time for discarding toner is not required. Therefore, an operation rate of a printer can be improved.

Because the print duty D is calculated by using the drum actual rotation number Nkr that includes a period from initially feeding a sheet through detecting the trailing edge of the sheet after transferring a toner image, including a vacuity carrying period in which the toner image is not transferred on the sheet, toner charging amount in which actual level of the rubbing of toner on the developing roller can be reflected to the toner discarding processing. Therefore, an occurrence of the blot toner is certainly prevented.

Second Embodiment

Figure 9:
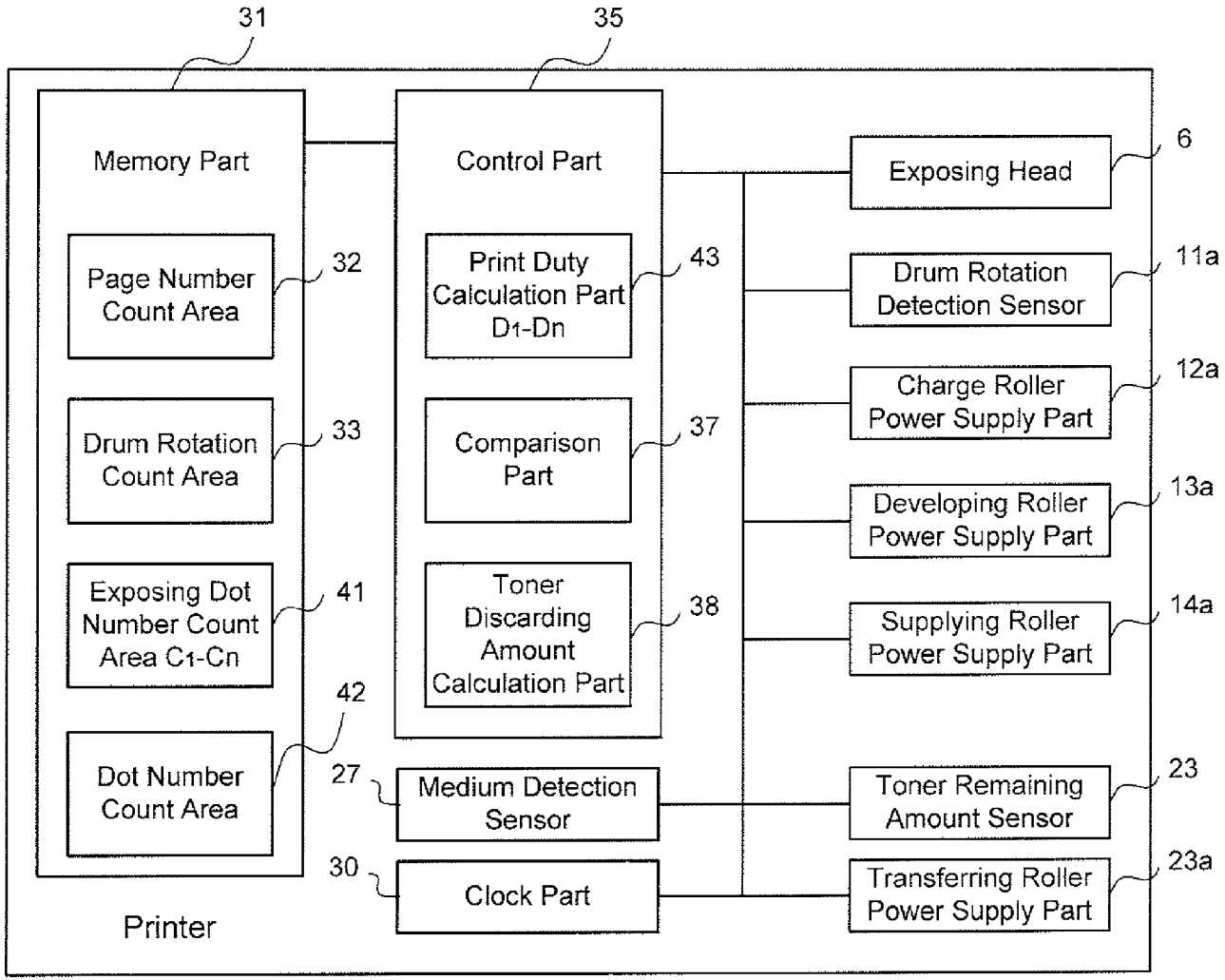
FIG. 9 is a block diagram of a printer according to a second disclosed embodiment.

FIG. 9 is a block diagram of a printer according to a second embodiment.

An explanation for a portion that is the same as the first embodiment is omitted by assigning the same reference numerals.

A memory part 31 of a printer 1 according to the present embodiment has a page number count area 32 and a drum rotation count area 33 in advance as in the first embodiment. The memory part 31 also has an exposing dot number count area 41 for counting exposing dot numbers $C_1$~$C_n$ in each dot unit configured with LEDs 6*a* (see FIG. 3) of an exposing head 6 and a dot number count area 42 for counting a dot number x of the LEDs 6*a* of the exposing head 6 in advance.

In the memory part 31, a standard duty Kd (3% in this embodiment), a standard remaining amount Km (40 g in this embodiment), and a total dot number n that is a total number of the LEDs 6*a* of the exposing head 6 are set and are stored in advance as in the first embodiment.

Figure 11A:
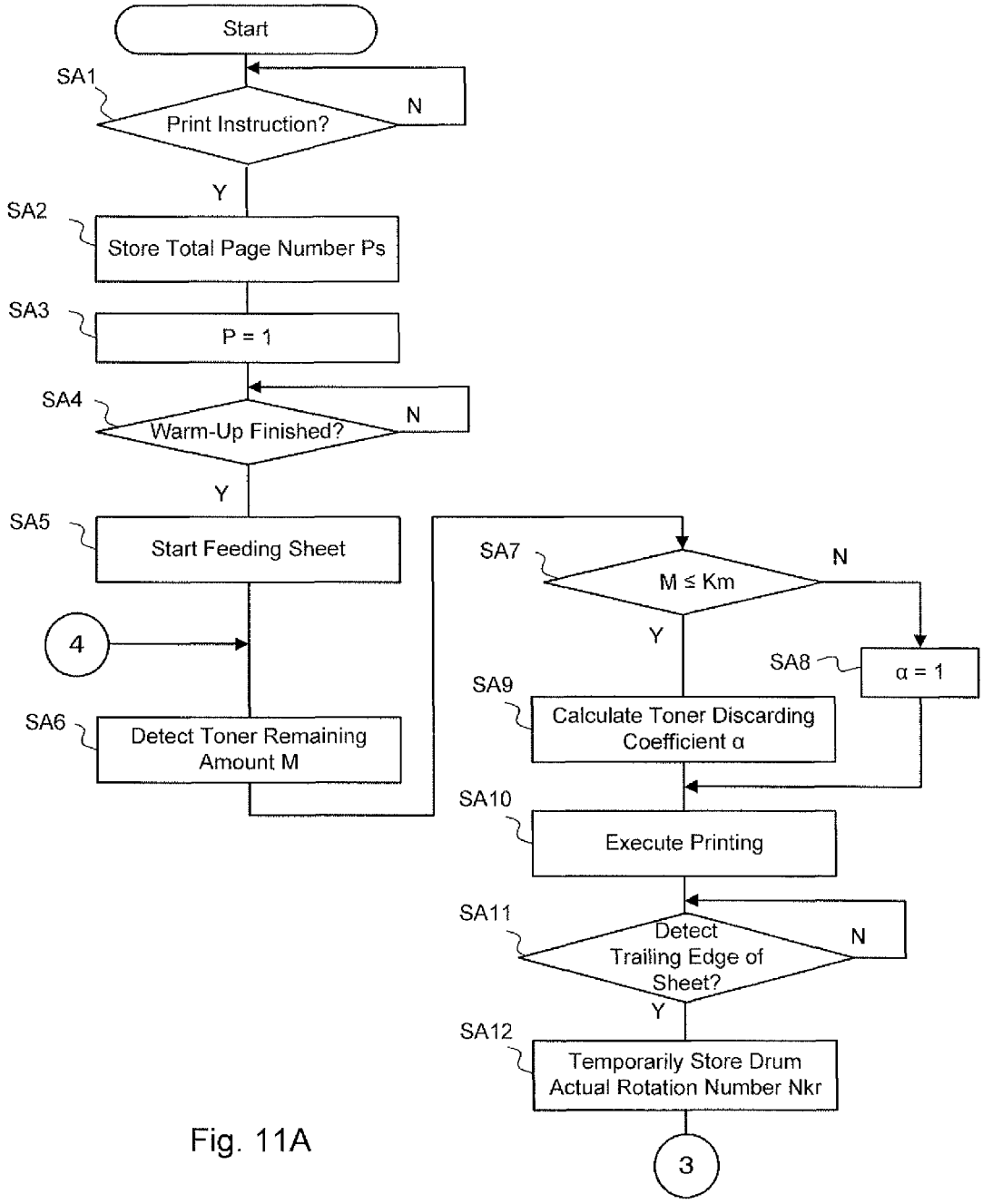
FIGS. 11A and 11B are flow diagrams of print processing and toner discarding processing according to a second disclosed embodiment.
Figure 11B:
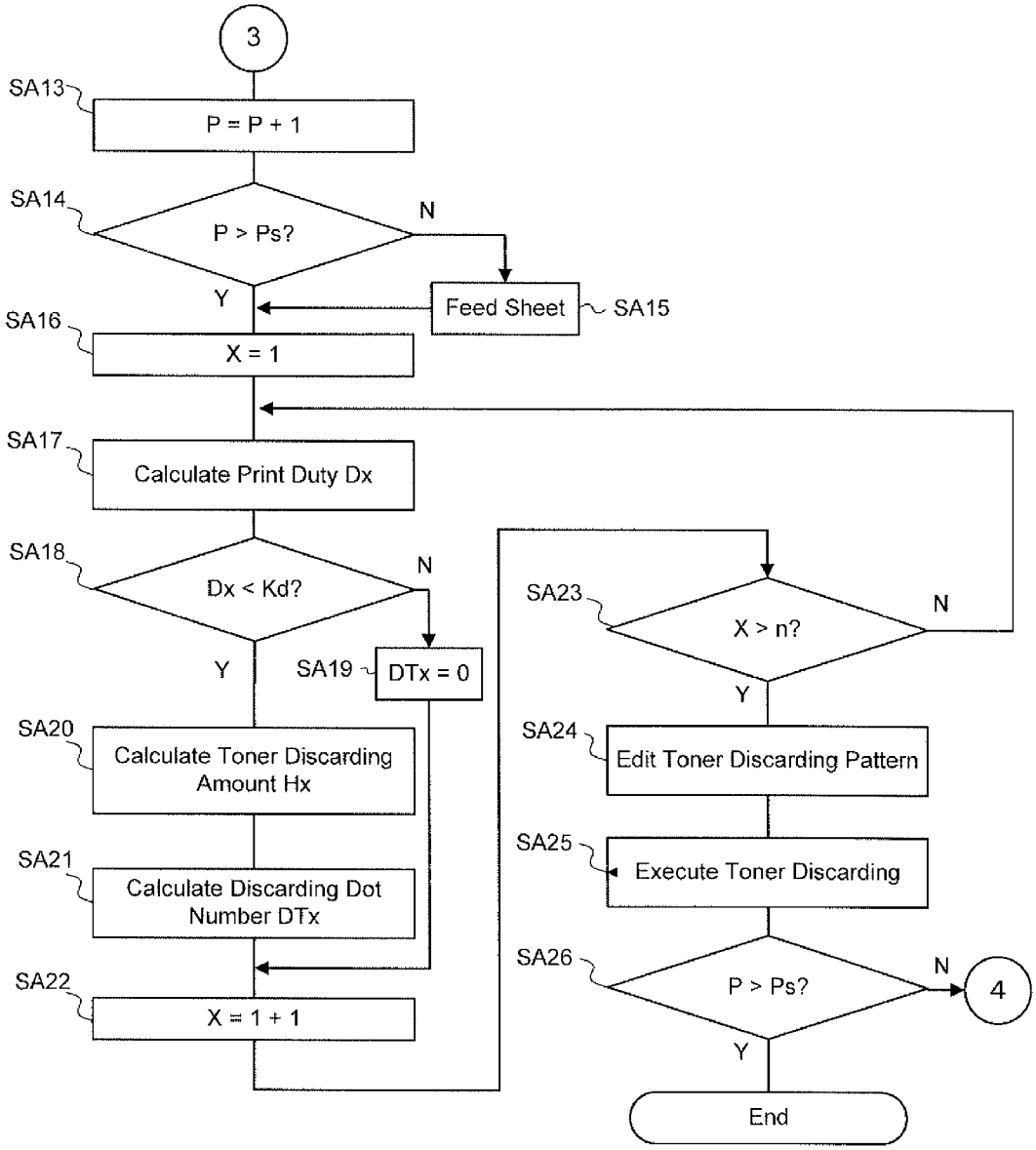

A control part 35, according to the present embodiment, has a function to execute task processing, such as print processing and toner discarding processing that are explained with reference to FIG. 11, by controlling each part of the printer 1 with a print task execution program stored in the memory part 31.

In the control part 35, for example, the following several function parts are formed: a print duty calculation part 43 for calculating print duties $D_1$~$D_n$ in each dot unit per a print sheet in which a median exposing dot number per rotation, which is calculated by the exposing dot numbers $C_1$~Cn in each dot unit of the exposing dot number count area 41 and the drum actual rotation number Nkr of the drum rotation count area 33, is converted in an actual print area by software of the print task execution program; a comparison part 37 as in the first embodiment; and a toner discarding amount calculation part 38 as in the first embodiment.

The print performance of the printer 1 according to the present embodiment is the same as that of the first embodiment discussed above. Therefore, its explanation is omitted.

The toner discarding performance of the printer 1 according to the present embodiment is the same as the toner discarding performance of the first embodiment discussed above. However, there is a difference in which toner is discarded in a dot unit. The difference is explained below.

When the control part 35 receives a print instruction, the control part 35 instructs to count the drum actual rotation number Nkr of the photoreceptor drum 11 through the drum rotation count area 33 and to count exposing dot numbers $C_1$~$C_n$ in each dot unit that is exposed by the exposing head 6 at the time of forming an electrostatic latent image on the photoreceptor drum 11 through the exposing dot number count area 41 in print performance for one sheet 2, as in the first embodiment.

In this case, the drum actual rotation number Nkr is the same as the first embodiment discussed above.

Then, the control part 35 instructs to calculate a median exposing dot number (=Cx/Nkr; x=1~n) per rotation of the drum actual rotation number Nkr in each dot number x based on these two count values through the print duty calculation part 43. The control part 35 also instructs to calculate the print duty Dx, which converts the median exposing dot number into an actual print area of a sheet 2 in which printing is actually performed, per print sheet for each dot number x through the following formula (5).

In other words, when solid printing on an entire surface of the printable area of a size of the sheet 2 that is used for printing is performed, a total dot number in the auxiliary scanning direction is set as Cfs. A drum print rotation number is set as Nki. The print duty Dx is calculated by the following formula (5).

$$Dx=100\times(Nki\times Cx/Nkr)/Cfs(\text{unit:}\%) \quad (5)$$

A higher print duty Dx means that a toner consumption amount in a current print performance of the LEDs 6*a*, i.e., dot numbers in the auxiliary direction, is large. A lower print duty Dx means that a blot likely occurs in the next print performance because the toner consumption amount in current print performance of the LEDs 6*a* is small.

Next, the control part 35 instructs the comparison part 37 to compare the calculated print duties $D_1$-$D_n$ with the standard duty Kd stored in the memory part 31. When the calculated print duty Dx is equal to or more than the standard duty Kd, the toner discarding performance is not conducted at the portion in the main scanning direction where the LEDs 6*a* are located. When the calculated print duty Dx is less than the standard duty Kd, the toner discarding performance is executed at the portion in the main scanning direction where the LEDs 6*a* are located.

Then, when the execution of the toner discarding performance is determined, the control part 35 instructs to calculate the toner discarding amount Hx through the toner discarding amount calculation part 38, in which the toner discarding amount Hx is proportional to the difference that is calculated by deducting the print duty Dx from the standard duty Kd. The toner discarding amount Hx is calculated as follows:

$$Hx=\alpha(Kd-Dx)(\text{unit:}\%) \quad (6)$$

The discarding dot number DTx of the toner discarding pattern that corresponds to the calculated toner discarding amount Hx is calculated by the following formula (7).

$$DTx=Hx\times Cs=\alpha(Kd-Dx)Cfs(\text{unit:dot}) \quad (7)$$

In this case, when the toner remaining amount M is equal to or less than the standard remaining amount Km (40 g), the toner discarding coefficient is calculated through the formula (4) that is explained in the first embodiment above.

Then, the control part 35 instructs to send print data for the toner discarding pattern that is edited based on the calculated discarding dot number DTx in dot unit to the exposing head 6 so that the toner discarding performance is executed as in the first embodiment.

Figure 10B:
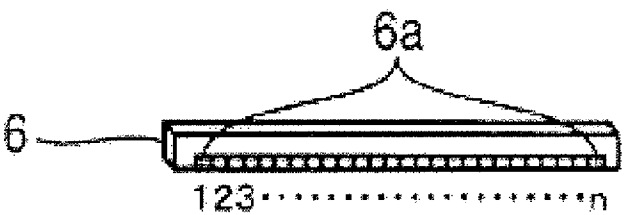
FIG. 10B is a schematic view showing a toner discarding pattern according to a second disclosed embodiment.
Figure 10B:
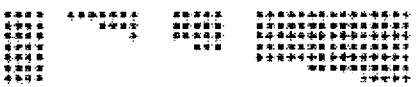
Figure 10A:
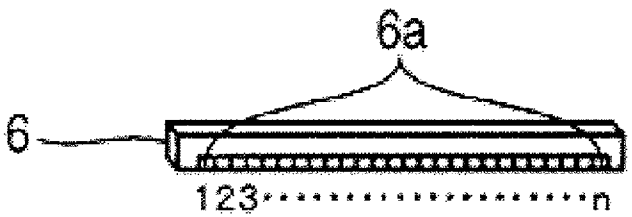
FIG. 10A is a schematic view showing a print pattern according to a second disclosed embodiment.
Figure 10A:
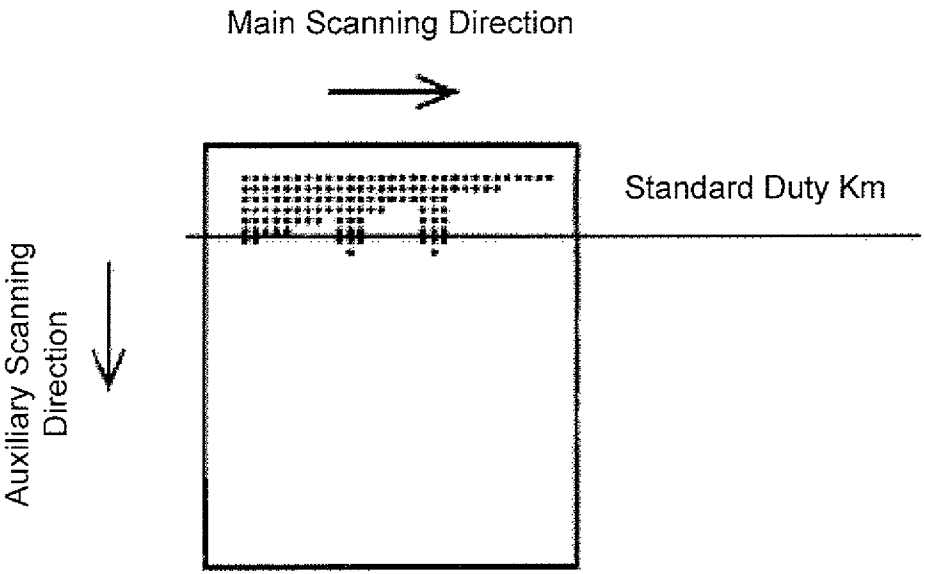

When the print pattern is printed on the sheet 2 as shown in FIG. 10A, the toner discarding pattern is shown in FIG. 10B. In the toner discarding pattern shown in FIG. 10B, a discarding dot number DTx in each of portions of the LEDs 6*a* is as follows. In a portion of the LEDs 6*a* in which the print duty Dx is equal to or more than the standard duty Km, the discarding dot number DTx of the toner discarding pattern is equal to "0." In a portion of the LEDs 6*a* in which the print duty Dx is less than the standard duty Km, but a lot of toner is consumed, the discarding dot number DTx of the toner discarding pattern is small. In a portion of the LEDs 6*a* in which the print duty Dx is less than the standard duty Km, and a little bit of toner is consumed, the discarding dot number DTx of the toner discarding pattern is large. In a portion in which the print duty Dx is equal to "0", for example, in margin areas that are located in both sides in the auxiliary scanning direction, the toner discarding pattern in which the discarding dot number DTx is maximum is formed.

As a result, even though a print pattern that makes it easy to generate a blot in a particular portion is performed, toner discarding with spot processing specialized for the portion can be conducted. And, the toner discarding amount H can be minimum.

This is particularly effective for consuming toner effectively while saving toner consumption amount after toner remaining amount M in the toner hopper 16 of the image forming unit 7 is very low.

Next, print processing and toner discarding processing according to the present embodiment are explained below in steps, SA, with reference to a flow diagram shown in FIG. 11.

Performance SA1~SA15 according to the present embodiment is the same as performance of corresponding operations S1~S15 according to the first embodiment so that those explanations are omitted.

However, note that at SA2, the control part 35 instructs to calculate the drum print rotation number Nki of the photoreceptor drum 11 and a total dot number Cfs in a printable area in the auxiliary scanning direction based on a size of the sheet 2 and the margin area that are read and to store them in the memory part 31.

Also note that at SA10, exposing dot numbers $C_1$~$C_n$ in the dot unit that are exposed by the exposing head 6 are counted based on print data that is outputted to the exposing head 6 through the exposing dot number count area 41.

At SA16, after the control part 35 determines that transferring of the toner image for the last page finishes, or that carrying of the new sheet 2 to the image forming unit 7 is started, the control part 35 instructs to set a count number of the dot number count area 42 in the memory part 31 as "1" and to set a dot number x for calculating the print duty Dx and so on at first as "1."

At SA17, after the dot number x is set by the control part 35, the control part 35 instructs to retrieve toner on the photoreceptor drum 11 by the cleaning performance as at S16 of the first embodiment discussed above and to eject the sheet 2 on which the print pattern is printed to outside of the printer 1.

The control part 35 instructs the followings at the same time of this: a print duty Dx is calculated through formula (5) based on the drum actual rotation number Nkr that is temporarily stored in the memory part 31, the exposing dot number Cx that corresponds to the dot number x in the exposing dot number count area 41 of the memory part 31, the drum print rotation number Nki that is stored in the memory part 31, and the total number of dots Cfs.

At SA18, after the print duty Dx is calculated by the control part 35, the control part 35 instructs the following: after the standard duty Kd (3% in this embodiment) that is stored in the memory part 31 is read, the calculated print duty Dx is compared with the standard duty Kd by the comparison part 37; when the comparison part 37 determines that the print duty Dx is less than the standard duty Kd (i.e., "Yes"), the processing goes to SA20; and when the comparison part 37 determines that the print duty Dx is equal to or more than the standard duty Kd (i.e., "No"), the processing goes to SA19.

At SA19, after the control part 35 determines that the print duty Dx is equal to or more than the standard duty Kd, the control part 35 instructs the toner discarding amount calculation part 38 to set the discarding dot number DTx of the corresponding dot number x as "0", to store this in the memory part 31, and the processing goes to SA22.

At SA20, after the control part 35 determines that the print duty Dx is less than the standard duty Kd, the control part 35 instructs the toner discarding amount calculation part 38 to calculate the toner discarding amount Hx through formula (6). The toner discarding amount Hx is in proportion to the difference that is obtained by deducting the print duty Dx from the standard duty Kd.

At SA21, after the toner discarding amount Hx is calculated by the control part 35, the control part 35 instructs the toner discarding amount calculation part 38 to calculate the discarding dot number DTx of the dot number x of the toner discarding pattern that corresponds to the toner discarding amount Hx through formula (7) and to store it in the memory part 31.

At SA22, after the discarding dot number DTx of the dot number x is stored in the memory part 31 by the control part 35, the control part 35 instructs to update the dot number x by adding "1" to the current dot number x and to set a dot number x for calculating a print duty Dx and so on next time.

At SA23, after the dot number x is updated by the control part 35, the control part 35 instructs the following: a total dot number n that is stored in the memory part 31 is read; the updated dot number x is compared with the total dot number n by the comparison part 37; when the comparison part 37 determines that the dot number x is equal to or less than the total dot number n, the processing returns to SA17 and continues to calculate next print duty Dx and so on; when the comparison part 37 determines that the dot number x is more than the total dot number n, it is determined that storing the discarding dot numbers DTx for all of the dot number x finishes; and the processing goes to SA24.

At SA24, after storing the discarding dot numbers DTx for all of the dot number x finishes by the control part 35, the control part 35 instructs the toner discarding amount calculation part 38 to read the total dot number Cfs and the discarding dot numbers $DT_1$~$DT_n$ that are stored in the memory part 31 and to edit the toner discarding pattern based on the read discarding dot numbers $DT_1$~$DT_n$ (see FIG. 10B).

At SA25, after the toner discarding pattern is edited by the control part 35, the control part 35 instructs to send print data of the toner discarding pattern to the exposing head 6 and to execute the toner discarding performance discussed above.

At SA26, after the toner discarding performance finishes by the control part 35, the control part 35 instructs the following: the updated page number P is compared with the total number of pages Ps by the comparison part 37; when the comparison part 37 determines that the page number P is equal to or less than the total number of pages Ps (i.e., "No"), the processing returns to SA6 and continues to print on the next sheet 2; and when the comparison part 37 determines that the page number P is more than the total number of pages Ps (i.e., "Yes"), printing based on the received print instruction finishes.

As discussed above, the toner discarding processing according to the present embodiment has the following features and effects. After the discarding dot numbers DTx that are exposed at the time of the toner discarding performance are calculated for all of the dot numbers x=1~n of the exposing head 6, respectively, the toner discarding pattern is edited based on calculated each of the discarding dot numbers DTx. Then, discarding toner is performed in a dot unit as resolution in the main scanning direction of the exposing head 6. When a portion in which a print duty Dx is low, a margin area, or the like is printed, toner consumption is small. Because discarding toner can be performed on only a portion in which a blot likely occurs, the toner consumption amount can be saved. A certain amount of toner can be supplied in any portions in the main scanning direction. Differences of print quality in the main scanning direction are hard to occur. These differences are caused by differences of process conditions, such as friction or abrasion, and electric potential history, which likely occurs when continuous printing of a print pattern with a low print duty D is performed, between a printing portion and a non-printing portion. Therefore, further uniform print quality can be maintained.

A toner discarding performance with a toner discarding pattern and toner discarding amount Hx that can be capable of various print patterns can be conducted. When continuous printing under the conditions in which to toner remaining amount M in the image forming unit 7 is small so that the amount of toner that can be used for printing is excessively small is performed, an occurrence of a blot is prevented while saving toner consumption amount.

Further, because discarding toner is performed during a period of printing performance except for a period for transferring a toner image, a waiting time for discarding toner is not required. Therefore, an operation rate of a printer can be improved.

Because the print duty Dx is calculated by using the drum actual rotation number Nkr that includes a period from feeding a sheet 2 through detecting the trailing edge of the sheet 2 after transferring a toner image including a vacuity carrying period in which the toner image is not transferred on the sheet, a toner charging amount in which actual level of rubbing of toner on the developing roller 13 can be reflected to the toner discarding processing. Therefore, an occurrence of the blot toner is certainly prevented.

As explained above, the present embodiment has the following effects in addition to the effects that are the same as the first embodiment discussed above. Because discarding toner is performed in a dot unit as resolution in the main scanning direction of the exposing head, toner consumption is small at the time of printing. Because discarding toner can be performed on only a portion in which a blot likely occurs, the toner consumption amount can be saved. Differences of print quality in any portions in the main scanning direction that are caused by differences of process conditions and so on are prevented. Therefore, further uniform print quality can be maintained.

In each of the embodiments discussed above, it is explained that the toner discarding performance is executed by calculating the toner discarding amount for each single sheet. The timing for the calculation of the toner discarding amount and execution of the toner discarding performance is not limited to the above discussion. A toner discarding performance may be conducted for certain pages or for each print job. Alternatively, a toner discarding performance may be conducted in the following situation: printing that is performed below the standard duty is continued; and then, when cumulative toner amount to be discarded reaches a certain amount, toner that corresponds to the cumulative amount may be discarded.

In each of the embodiments, specific numbers and formulas are shown as examples of toner discarding processing. However, the embodiments are not limited to these numbers and formulas so long as a blot can be avoided by the situation in which the more the toner remaining amount M was smaller, the more the toner discarding amount H was larger.

In each of the disclosed embodiments, a printer is explained as an image forming device. However, an image forming device is not limited to a printer. An image forming device can be a photocopy machine, a facsimile machine, and a multifunction machine that has functions of a photocopy machine, a facsimile machine, and a printer.

The image forming device being thus described, it will be apparent that the same may be varied in many ways. Such variations are not to be regarded as a departure from the spirit and scope of the invention, and all such modifications as would be apparent to one of ordinary skill in the art are intended to be included within the scope of the following claims.

What is claimed is:

1. An image forming device comprising:

an image carrier;

an exposing part configured to form an electrostatic latent image on the image carrier in dot unit;

a developing member configured to develop the electrostatic latent image by using developer;

a developer reserving part configured to supply the developer to the developing member;

a detection part configured to detect a developer remaining amount in the developer reserving part;

a first count part configured to count a rotation number of the image carrier during print performance;

a second count part configured to count an exposing dot number exposed by the exposing part;

a first calculation part configured to calculate a print duty for a print sheet based on the rotation number of the image carrier and the exposing dot number; and a discarding part that is configured to change an amount of the developer discarded depending on the developer remaining amount detected by the detection part, and to discard a larger amount of the developer when the developer remaining amount is equal to or less than a standard remaining amount, and when the print duty is less than a standard duty, compared to the amount of the developer discarded when the developer remaining amount is more than the standard remaining amount.

2. The image forming device according to claim 1, further comprising:

a second calculation part configured to calculate a discarding amount of the developer based on a difference between the standard duty and the print duty.

3. The image forming device according to claim 1, wherein calculation for the print duty is performed in a dot unit as resolution in the main scanning direction of the exposing part.

4. The image forming device according to claim 2, wherein calculation for the print duty is performed in a dot unit as resolution in the main scanning direction of the exposing part.

5. The image forming device according to claim 1, further comprising:

a cassette containing a medium used for printing, wherein the discarding of the developer is performed during a period from feeding the medium from the cassette through ejecting the medium from the image forming device after printing.

6. The image forming device according to claim 2, further comprising:

a cassette containing a medium used for printing, wherein the discarding of the developer is performed during a period from feeding the medium from the cassette through ejecting the medium from the image forming device after printing.

7. The image forming device according to claim 3, further comprising:

a cassette containing a medium used for printing, wherein the discarding of the developer is performed during a period from feeding the medium from the cassette through ejecting the medium from the image forming device after printing.

8. The image forming device according to claim 1, further comprising:

a control part configured to execute task processing on the image forming device; and a comparison part configured to compare the developer remaining amount with the standard remaining amount, and to determine whether the developer remaining amount is equal to or less than the standard remaining amount, wherein the control part is further configured to generate a developer discarding coefficient based on the determination of whether the developer remaining amount is equal to or less than the standard remaining amount, the developer discarding coefficient is set to be equal to 1 when the developer remaining amount is more than the standard remaining amount, and the developer discarding coefficient is set to be larger than 1 when the developer remaining amount is equal to or less than the standard remaining amount.

9. The image forming device according to claim 1, wherein the discarding part further includes a cleaning device having a cleaning blade, the exposing part is further configured to form a developer discarding pattern on the image carrier in dot units during a discarding performance, the developer discarding pattern being determined based on a discarding amount of the developer, and the discarding part is further configured to remove the developer discarding pattern from the image carrier during a discarding performance using the cleaning blade.

10. The image forming device according to claim 1, further comprising:

a transferring roller configured to transfer the electrostatic latent image to a medium for printing when a transferring voltage is applied to the transferring roller, wherein the transferring voltage is applied to the transferring roller during a printing performance, and the transferring voltage is not applied to the transferring roller during the discarding performance.

11. A method of forming an image on a medium for printing, comprising:

receiving a print data for printing the image;

feeding the medium for printing into a carrying path;

detecting a developer remaining amount of developer in a developer reserving part;

comparing the detected developer remaining amount and a standard remaining amount to determine whether the developer remaining amount is equal to or less than the standard remaining amount;

printing the image on the medium for printing based on the print data, the image being created from the developer formed on an image carrier;

counting an exposing dot number that is exposed on the image carrier by an exposing head during the printing of the image based on the print data;

counting a rotation number indicative of a number of times the image carrier has rotated during the printing of the image;

calculating a print duty based on the rotation number of the image carrier and the exposing dot number determining whether the print duty is less than a standard duty; and executing developer discarding to discard a larger amount of the developer when the developer remaining amount is equal to or less than the standard remaining amount, and when the print duty is less than the standard duty, compared to the amount of the developer discarded when the developer remaining amount is more than the standard remaining amount.

12. The method of forming an image according to claim 11, further comprising:

calculating a developer discarding amount prior to executing the developer discarding, if it was determined that the print duty is less than the standard duty, wherein the developer discarding amount is determined based on the difference between the standard duty and the print duty.

13. The method of forming an image according to claim 12, wherein the developer discarding amount is set to be in inverse proportion to the developer remaining amount.

14. The method of forming an image according to claim 12, wherein the calculating of the developer discarding amount further includes:

setting a developer discarding coefficient based on whether the developer remaining amount is determined to be equal to or less than the standard remaining amount, or whether the developer remaining amount is determined to be not equal to or less than the standard remaining amount, and the developer discarding amount is determined based on the developer discarding coefficient.

15. The method of forming an image according to claim 14, wherein the developer discarding coefficient is set to be equal to 1 when the developer remaining amount is more than the standard remaining amount, and the developer discarding coefficient is set to be larger than 1 when the developer remaining amount is equal to or less than the standard remaining amount.

* * * * *